United States Patent [19]

Miglierini

[11] 4,056,153

[45] Nov. 1, 1977

[54] ROTARY ROCK BIT WITH MULTIPLE ROW COVERAGE FOR VERY HARD FORMATIONS

[75] Inventor: Raul A. Miglierini, Dallas, Tex.

[73] Assignee: Dresser Industries, Inc., Dallas, Tex.

[21] Appl. No.: 705,963

[22] Filed: July 16, 1976

Related U.S. Application Data

[63] Continuation of Ser. No. 581,998, May 29, 1975, abandoned.

[51] Int. Cl.[2] ..... E21B 9/08

[52] U.S. Cl. ..... 175/376; 175/374

[58] Field of Search ..... 175/341, 353, 331, 365–372, 175/374–376

[56] References Cited

U.S. PATENT DOCUMENTS

| | | | |
|---|---|---|---|
| 1,649,858 | 11/1927 | Reed | 175/371 X |
| 2,184,067 | 12/1939 | Zublin | 175/376 X |
| 2,318,370 | 5/1943 | Burch | 175/356 X |
| 2,774,571 | 12/1956 | Morlan | 175/374 X |
| 2,990,025 | 6/1961 | Talbert et al. | 175/375 |
| 3,134,447 | 5/1964 | McElya et al. | 175/374 X |
| 3,726,350 | 4/1973 | Pessler | 175/374 |
| 3,850,256 | 11/1974 | McQueen | 175/356 |
| 3,858,670 | 1/1975 | Ott et al. | 175/374 |

*Primary Examiner*—Ernest R. Purser
*Assistant Examiner*—Richard E. Favreau
*Attorney, Agent, or Firm*—Eddie E. Scott

[57] ABSTRACT

The body of the bit includes an axis of rotation, an upper end connectable with the drill string for rotating the bit and three downwardly projecting arms. Each of the arms includes an inwardly and downwardly inclined shaft defining an axis of cutter rotation with all of the axes intersecting at substantially a common point. First, second and third conical cutter members are journaled on a respective one of said shafts. Each cutter member includes a nose and a base with the base being oriented generally toward the wall of the well bore. A plurality of outwardly projecting, circumferentially-spaced inserts are located in annular rows in each cutter member for engaging the bottom of the well bore. At least two of the cutter members include intermediate rows of inserts disposed between the nose and base of the cutter member at approximately the same distance from the bit axis of rotation so that the inserts engage the bottom of the well bore at approximately the same distance from the bit body axis of rotation, thereby cutting overlapping tracks.

5 Claims, 7 Drawing Figures

ROTARY ROCK BIT WITH MULTIPLE ROW COVERAGE FOR VERY HARD FORMATIONS

This is a continuation of application Ser. No. 581,998, filed May 29, 1975, now abandoned.

BACKGROUND OF THE INVENTION

The present invention relates to the art of earth boring and, more particularly, to a rotary rock bit suitable for drilling in extremely hard formations, such as hard taconite where the usual multiple-purpose bit encounters problems because of the character of the extremely hard high-strength rock.

The rapidly increasing demand for the earth's natural resources such as oil and gas and various types of ores extracted by the mining industry has created the need for improved drilling bits. The present invention provides a drilling bit for drilling in extremely hard formations, such as are encountered in deep oil and gas wells and in drilling in hard ore-bearing formations such as the iron bearing taconite formations.

A more specific example of the need for the bit of the present invention will be described with reference to bits for use in applications for drilling blast holes such as those commonly encountered in mining areas where the holes are usually of relatively shallow depth. Current state of the art blast hole bits in use around the world perform satisfactorily in medium-hard to hard formations, but when extremely hard, high-strength formations are encountered, the bits suffer extreme battering of the cutting structure components in abnormally short rotating hours.

DESCRIPTION OF PRIOR ART

In U.S. Pat. No. 2,990,025 to Milton L. Talbert and William E. Scarborough, assigned to Dresser Industries, Inc. patented June 27, 1961, a rotary well drill bit is shown including a head with inwardly extending shafts thereon. Rolling cutters are rotatably mounted on said shafts. A first circumferential row of gage cutting, wear-resistant inserts are situated at the heel of at least one cutter. A second circumferential row of wear-resistant inserts on at least one of said cutters is spaced inwardly of the first row toward the longitudinal axis of the head with the spacing between the first and second rows being such that the track of the second row on the bottom of the hole being drilled overlaps the track of the first row. The first row is situated at substantially zero oversize angle and the second row is situated at a larger oversize angle than is said first row, so that the second row effects disintegration of the earth formations closely adjacent the wall of the hole at a level below the first row, whereby the formation to be disintegrated by the first row is left without substantial inner lateral support, thereby facilitating cutting the hole to gage by the first row.

In U.S. Pat. No. 2,774,571 to Erwin A. Morlan assigned to Hughes Tool Company patented Dec. 18, 1956 an earth boring drill including a head and a plurality of conical cutters rotatably mounted thereon is shown. Each of the cutters includes a body having a nose portion terminating proximate the axis of the drill. Each nose portion includes cutting elements thereon comprising a plurality of wear-resistant inserts secured therein and having an ovoid protrusion at the surface thereof. The inserts on the respective nose portions are in confronting and non-interfitting relation and are arranged thereon to engage and produce overlapping tracks upon the bottom of the bore being drilled and to thereby disintegrate the earth formations at and proximate the axis of the drill. The cutter bodies include spaced annular lands outwardly of the nose portions. The lands are spaced on the body so that each land overlies the space between the lands on the adjacent cutters. A series of wear-resistant inserts are secured in each of said lands. The inserts have ovoid protrusions at the surfaces of the lands, whereby said protrusions form cutting elements in inter-fitting relationship to effect a self-cleaning action and disintegrate bottom outwardly of said nose portions.

In U.S. Pat. No. 3,696,876 to Eugene G. Ott assigned to Dresser Industries, Inc. patented Oct. 10, 1972, a rotary drill bit is shown that is utilized in forming a well bore or the like. The rotary drill bit includes a bit body having three arms journaling three generally conical cutter members. Each of the cutter members is provided with a plurality of annular rows of outwardly projecting circumferentially-spaced inserts. The inserts are constructed from a material such as tungsten carbide and project from the surface of the cutter members for a considerable distance. The spacing of the annular rows is such that a substantial quantity of the bottom of the well bore is not subjected to the downward impression of the inserts as the bit is rotated in the well bore. The cutter members are arranged in such a manner that the axes thereof do not intersect each other, nor do they intersect the axis of rotation of the bit.

SUMMARY OF THE INVENTION

The present invention provides a new cutting structure for a three cone rock bit tailored for use in the very hardest formations found anywhere in the world. The present invention will offer superior performance for drilling bits in the hard taconite ores currently being exploited by the mining industry around the world to fill mankinds' continuing and increasing needs for products made from iron. The three cone rock bit of the present invention includes a bit body having an axis of rotation and a multiplicity of projecting arms. Each of the arms includes a shaft defining an axis of cutter rotation. All of the axes including the bit body axis of rotation intersect at a common point. A multiplicity of cutter members of generally conical configuration are journaled on one side of said shafts. The cutter members have a nose and a base with the base being oriented generally toward the wall of the borehole. A plurality of outwardly projecting, circumferentially-spaced inserts are located in annular rows in each cutter member for engaging the bottom of the borehole. At least two of the cutter members include annular rows of inserts mounted intermediately between the nose and base with said intermediate rows being located on said cutter members at substantially the same radial distance from said bit axis of rotation, whereby the tracks of said intermediate rows on the bottom of the borehole at least partially overlap. The above and other features and advantages of the present invention will become apparent from a consideration of the following detailed description of the invention when taken in conjunction with the accompanying drawings.

DETAILED DESCRIPTION OF THE INVENTION

Figure 1:
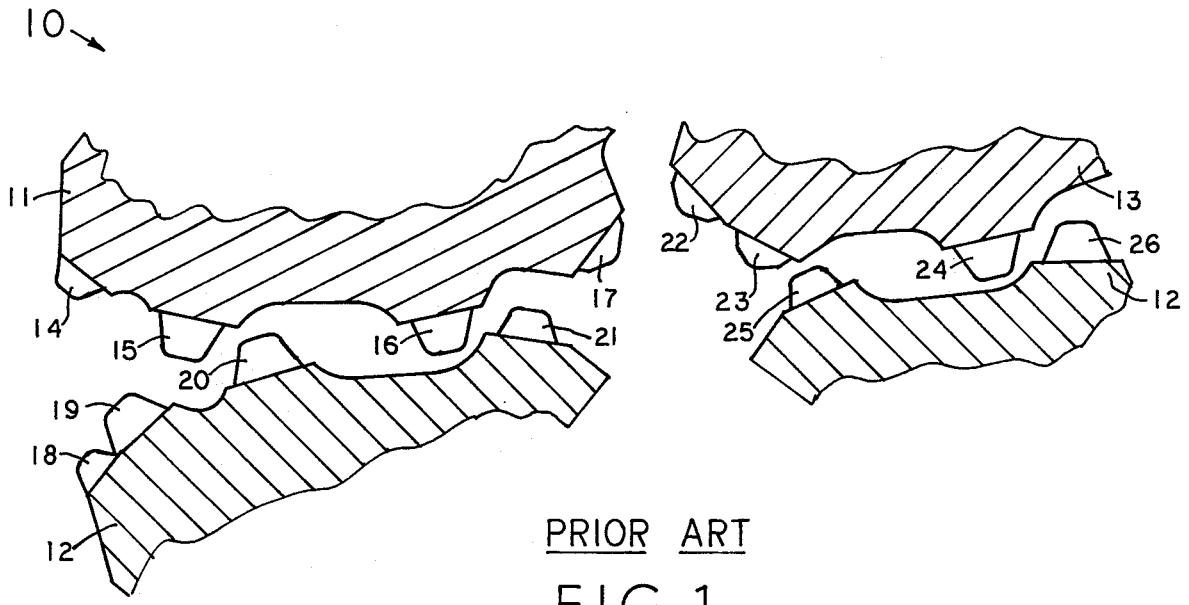
PRIOR ART FIG. 1
FIG. 1 is a standard cluster layout of a prior art three cone rotary rock bit showing the cone intermesh.
Figure 2:
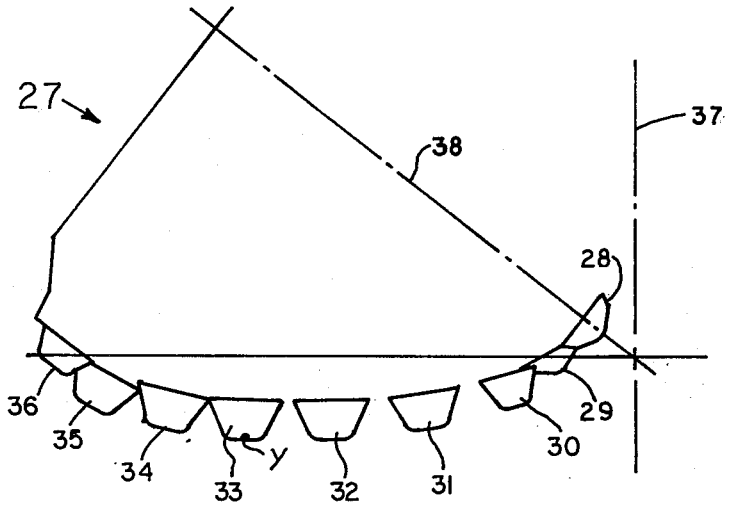
PRIOR ART FIG. 2
FIG. 2 is a superimposed representation of the cutter members of the prior art three cone rotary rock bit showing the bottom profile of a portion of a well bore bottom as the prior art drill is rotated in the well bore.
Figure 3:
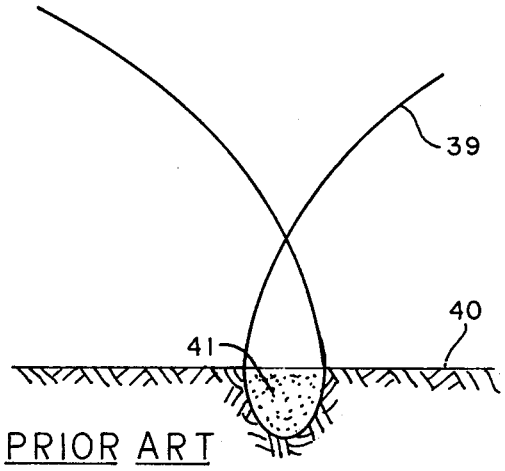
FIG. 3 represents an elevation of the well bore shown in FIG. 2 illustrating the locus of travel of a point on one of the inserts of the prior art bit shown in FIG. 2.

Current state-of-the-art blast hole bits in use around the world perform satisfactorily in medium-hard to hard formations, but when extremely hard high-strength formations are encountered, the bits as currently manufactured suffer extreme battering of the cutting structure components in abnormally short rotating hours. The design selection parameters for a state-of-the-art rock bit require that the cones be as large as possible within the hole diameter limitations thus necessarily including generally intermeshing rows as shown in FIG. 1. This design selection parameter limits the conglomerate of three intermeshing cones to one carbide row per track on bottom in the intermeshing area, which is a limitation well known to those familiar with the geometry of rock bit cone cluster layout. Further to this same delineation, when the cones are swelled beyond the true-rolling line as shown in FIG. 2, the tips of the carbide inserts extending beyond the true-rolling line create a "scraping" action on bottom as shown by the locus of travel of point "Y" illustrated in FIG. 3. This "action on bottom" can be readily seen to impart a side loading force on the carbide inserts which, though desireable in soft formation applications, is highly detrimental to the brittle tungsten carbide compact material in the ultra hard formations. Excessive side loadings as illustrated by FIGS. 2 and 3 would result in short insert life because of the chippage and breakage resulting from these forces, and this damage to the compacts would thereby reduce the effective life of the rock bit.

Referring again to FIG. 1 a standard cluster layout of a three cone rotary rock bit generally designated by the reference number 10 is shown. The bit 10 includes cones 11, 12 and 13. The cones 11, 12 and 13 have intermeshing rows of inserts. For example, cone 11 includes inserts 14, 15, 16 and 17. These inserts intermesh with inserts 18, 19, 20 and 21 on cone 12. In the same manner cone 13 includes inserts 22, 23 and 24 that intermesh with inserts 25 and 26 on cone 12.

A composite of the three cones of a bit 27 is shown in FIG. 2. The bit 27 rotates about axis 37. The axes of the cones are represented by line 38. The bit 27 includes inserts 28–36 adapted to contact and disintegrate the formations. It will be appreciated that the location of the inserts 28–36 does not correspond to a true conical shape. Accordingly the inserts 28–36 will not have true rolling action. The inserts 28–36 will be subjected to a scraping action on bottom. Movement of a point Y on the cutting surface of insert 33 is illustrated in FIG. 3 which illustrates the locus of travel of point Y as the bit 27 is rotated. The point Y follows the path shown by line 39. As point Y travels through the bottom 40 it passes through an area 41 of scraping action where the insert 33 moves laterally through the bottom 40. The insert 33 is subjected to side loading forces by the scraping action.

The present invention embodies true rolling cones and high density cutting element coverage. The present invention provides a cutting structure with essentially no "scraping", "gouging" or "tearing" action such as is often mentioned in other descriptions of rock bit cutting action, and which is specifically included in most rock bit structure design to add penetration rate through this normally beneficial "action on bottom". When ultra high bit loads are encountered, which is an irrefutable current trend in the mining industry characterized by the proliferation of ever larger and heavier drilling machines, the "action-on-bottom" which was once beneficial becomes harmful to the cutting structure precisely due to the high energy levels which can be imposed upon the drill bit by these large machines. Side loading on the individual cutting inserts on the drill bit cones can become such that the tungsten carbide is prematurely chipped or broken to an extent which will markedly reduce the life of the cutting structure to an undesirable level and drastically increase the cost per foot of hole drilled.

True rolling action, while well known in the drill bit industry as a means for the cutting element on the cone member to impart "pure compression" loading on bottom, in actuality is generaly not "pure" true rolling but is instead a compromise by the bit designer to satisy geometric desirabilities such as providing the largest cone diameters and bearings possible in a given hole size. These geometric parameters can be, and usually are, accomplished by using intermesh of cone rows and accepting an amount of non-true rolling more or less depending upon the designers' judgement of the drilling condition expected.

Figure 5:
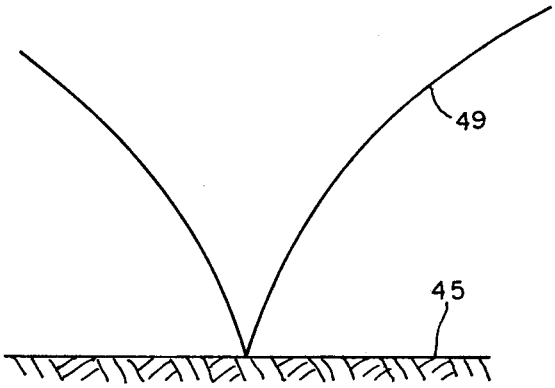
FIG. 5 represents an elevation of the well bore shown in FIG. 2 illustrating the locus of travel of a point on the cutting surface of the bit illustrated in FIG. 4.

In the bits illustrated in FIGS. 4–7 "pure" true-rolling cone elements are shown upon which the tips or ends of the insert cutting elements are placed — excepting only the gage row and one nose row on each cone — so that essentially the entire cutting structure is in a true-rolling mode, and all carbide inserts are rolling on bottom. Point A shown in FIG. 4 generates a locus of travel as shown in FIG. 5 and thus exerts a force on the formation which is purely compressive in nature. The compressive unit loading force is known, by those familiar with the requirements for drilling in very hard friable formations, as the principal mode for applying energy to effect the destroying of the formaton to be cut. It follows that the present design, which limits its action on bottom to compressive loading alone is thus superior to any compromise design as previously explained.

It is the principal purpose of this invention to provide a cutting structure that is complemented and aided by the aforedescribed pure true-rolling cones. The insert placement is arranged such that a high overall density on the total bit is achieved for the most effective destruction of bottom without endangering the cone shell strength through placing the inserts too close together.

Figure 4:
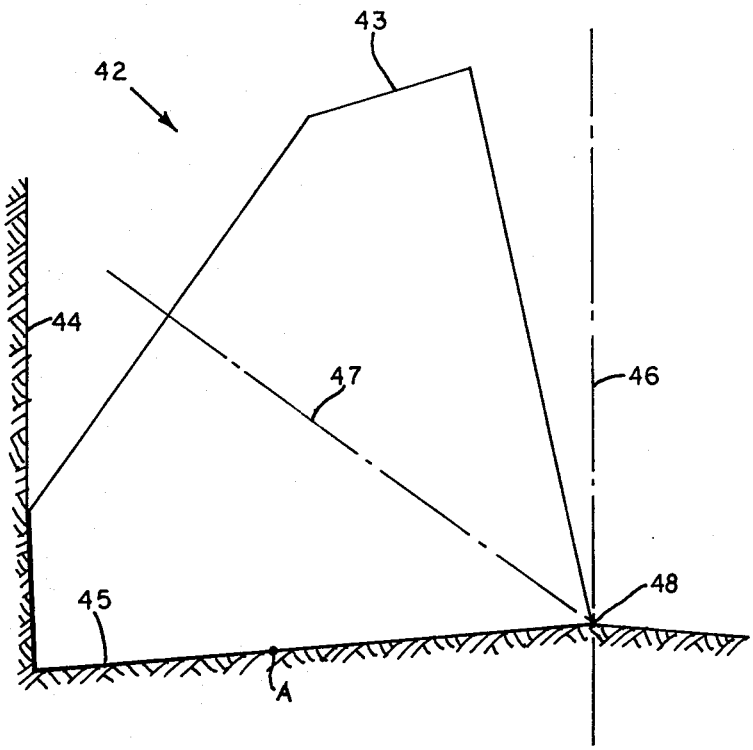
FIG. 4 is a diagrammatic illustration of a cutter member of the present invention illustrating the bottom profile of a portion of a well bore as the bit is rotated in the well bore.
Figure 7:
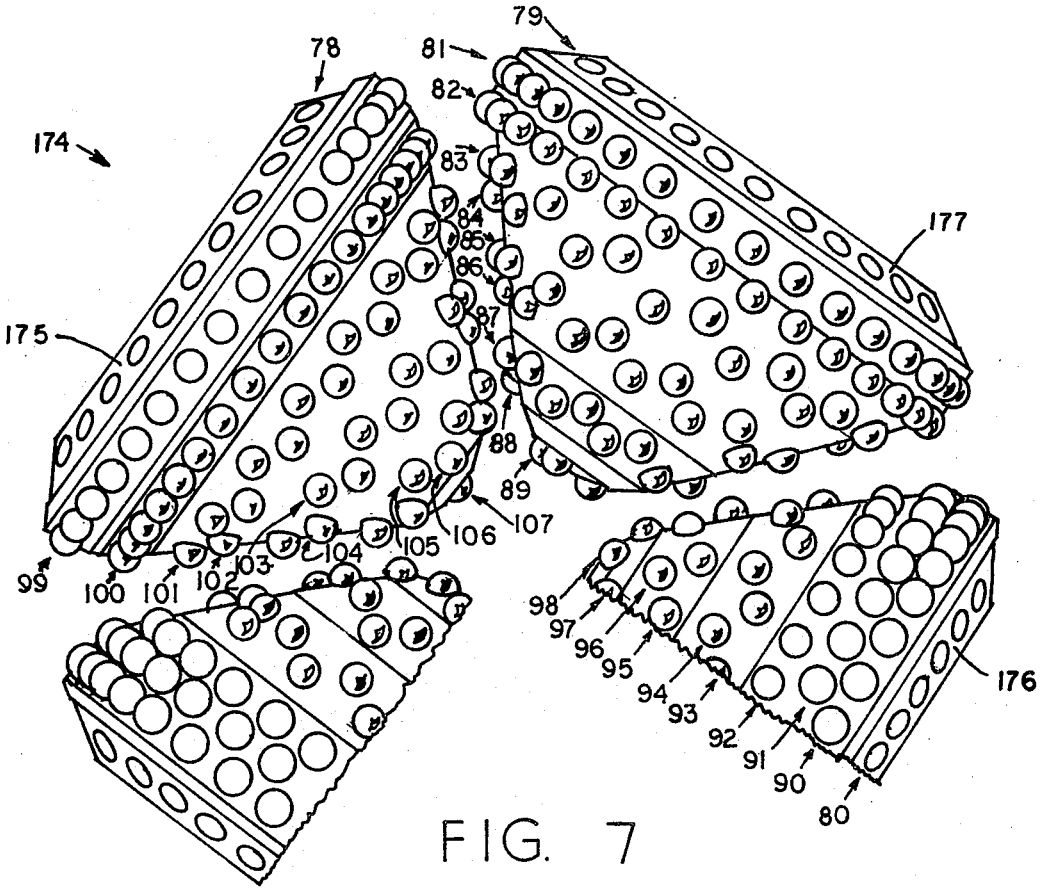
FIG. 7 is a standard cluster layout of a three cone rotary rock bit constructed in accordance with the present invention.

As shown by FIG. 7, the cones are completely out of intermesh and as shown by FIG. 4, the insert tips are on a line intersecting the established intersection of the hole and the cone journal indicating that this line is an element of a cone which would have pure true-rolling action on bottom were it to be an actual solid conical geometric object. By pulling the cones out of intermesh the bit is no longer limited, due to cone-to-cone interference, to having rows on alternate cones so that they roll in individually concentric bottom kerfs from inside to outside of the drilled hole, but may contain as many compacts as necessary wherever desired on the shells of the three conical elements comprising a three cone rock bit.

The present invention has a number of distinct advantages. Included in these advantages are the following:

a. A high density of compacts meeting bottom can be provided without a high density in the rows of individual cones by splitting the quantities between two or more cones.

b. By staggering the rows in individual cones, increased cone shell areas can be obtained thereby reducing the dangers of cone shell cracking.

c. The reduced compact densities on the individual cones meeting bottom at any instant in time will result in more unit loading on bottom with attendant increase in penetration rate.

d. The increased unit loading on bottom allows for the compressive strength of the formation to be overcome by the individual insert with less overall loading on the bit through the drill stem, resulting in added bearing life. In summation, it can be seen through the geometry of placement of the cones which achieves "pure" true-rolling action, the carbide cutting inserts, as herein described, receive none of the side loading reaction forces from the formation, but do, instead, meet the formation straight on in pure compression, compression being the direction of maximum strength of the tungsten carbide material. This basic concept opens limitless new avenues for variations geared to special purpose applications.

Referring again to FIG. 4, a diagrammatic representation of a cutter member 43 of a bit 42 of the present invention is shown illustrating the profile of the cutter 43 and the profile of a portion of the bottom of a borehole 44 as the bit 42 is rotated. The bit 42 rotates about an axis 46. The axis 47 of the cone 43 intersects the bit axis 46 at point 48. The tips of the inserts of the cone 43 act to form substantially a straight line on the bottom 45 of the borehole 44. This provides true-rolling action for the cone 43.

FIG. 5 is an elevation of the borehole 44 illustrating the locus of travel of a point on the cutting surface of an insert on the cone 43 illustrated in FIG. 4. The point follows a path shown by line 49. As the point travels to the bottom 45 of the borehole 44, it is subjected to only compressional forces and does not encounter side loading.

Figure 6:
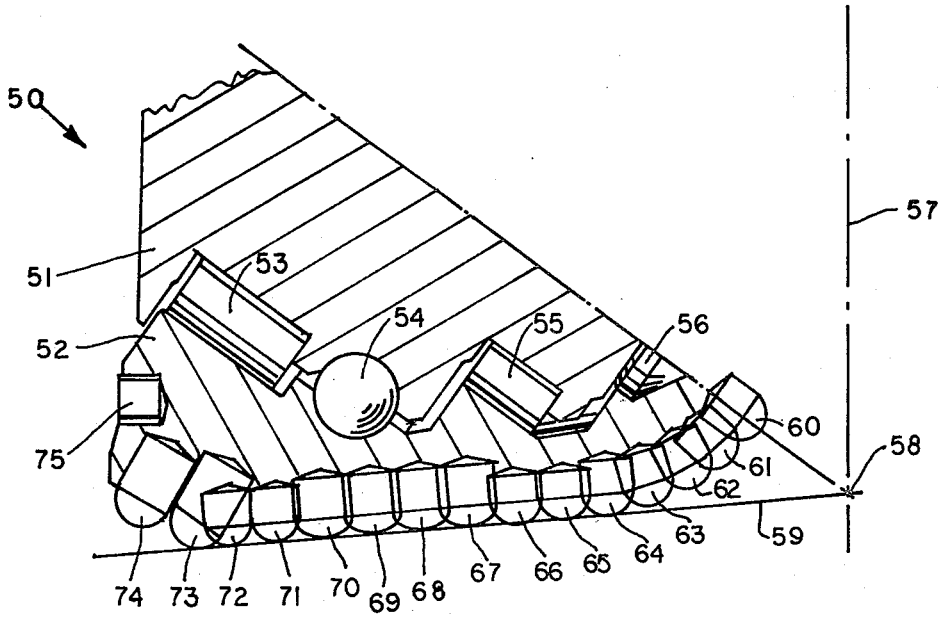
FIG. 6 is a superimposed view illustrating a portion of the cutter members of a three cone rotary rock bit constructed in accordance with the present invention showing the bottom profile of a portion of the well bore bottom as the drill bit is rotated in the well bore.

Referring now to FIG. 6, a composite of the three cones of a bit 50 is illustrated. The bit 50 rotates about axis 57. The axes of the cones are represented by a line that intersects the bit axis 57 at a common point 58. This provides the three cones and the bit 50 with true-rolling action. In order to illustrate the bit 50 a bearing pin 51 and cutter 52 are shown. It is to be understood that two other bearing pins and cutters (not shown) are included in the bit 50. A series of roller bearings 53, a series of ball bearings 54, a series of roller bearings 55 and a thrust button 56 are provided between the bearing pin 51 and cone cutter 52 to promote rotation of the cutter member 52. The bit 50 includes inserts 60–75 adapted to contact and disintegrate the formation. The tips of the inserts generally correspond to a true-conical shape. Accordingly, the cone 52 and bit 51 will have true-rolling action. It will be noted in particular that inserts 63–73 form substantially a straight line on the bottom 59 of the borehole.

Referring now to FIG. 7, a standard cluster layout of a three-cone rotary rock bit generally designated by the reference number 174 is shown. The bit 174 includes cones 175, 176 and 177. The cones 175, 176 and 177 have numerous rows of inserts; however, none of the rows of inserts on any one of the cones intermesh with the inserts on any other cone. The rows of inserts are arranged so that inserts on more than one cone cut overlapping tracks on the bottom of the borehole. Rows 78, 78 and 80 of surf compacts and rows 99, 81 and 90 of gage cutting inserts are provided on the cone cutters 175, 177 and 176, respectively. Cone cutter 175 includes a nose insert 107. Cone cutter 176 includes two rows of nose inserts 97 and 98. Cone cutter 177 includes a row of nose inserts 89. Mounted between the gage row of inserts and the nose insert (or row of nose inserts) of the respective cone cutters are a number of intermediate rows of inserts. These intermediate rows of inserts are arranged to cut overlapping tracks on the bottom of the borehole. Cone cutter 175 includes intermediate rows of inserts 100–106. Cone cutter 176 includes intermediate rows of inserts 91–96. Cone cutter 177 includes intermediate rows of inserts 82–88. The rows of inserts on one cone will cut a track on bottom overlapping the track cut by a row of inserts on another cone.

I claim:

1. A three cone rotary bit for drilling by disintegrating the formations at the bottom of a borehole, comprising: a head; three bearing pins extending from said head; and three rolling cutters of generally conical configuration, each cutter rotatably mounted upon a respective bearing pin, each of said cutters having a nose and a base and each of said cutters having intermediate circumferential rows of individual mounted in sockets in said cutters with said intermediate rows being spaced between said nose and base so that in a majority of instances the track of an intermediate row of one cutter on the bottom of the borehole at least partially overlaps the track of an intermediate row of one of the other cutters on the bottom of the borehole, said intermediate circumferential rows of inserts being completely out of intermesh and a composite of the inserts of said intermediate rows of all three cutters having the tips of the inserts forming substantially a straight line.

2. A rotary drill bit for forming a well bore or the like by removing the formations at the bottom of the well bore leaving a well bore wall, said bit comprising:

a bit body having an axis of rotation, an upper end connectable with a drill string for rotating said bit, and three downwardly projecting arms, each of said arms including an inwardly and downwardly inclined shaft defining an axis of cutter rotation, all of said axes substantially intersecting at a common point;

first, second and third cutter members of generally conical configuration, each of said cutter members being journaled on a respective one of said shafts and having a nose and a base, said base being oriented generally toward the wall of the well bore; and a plurality of outwardly projecting, circumferentially-spaced inserts located in annular rows in each said cutter member for engaging the bottom of the well bore;

the annular rows of inserts in said first, second and third cutter members including intermediate rows of inserts disposed intermediately between the nose and the base of said cutter members with said intermediate rows of inserts being completely out of intermesh, each annular row of inserts on one cutter member having a companion annular row of inserts on another cutter member with both of said intermediate rows being spaced from said bit axis of rotation by approximately the same distance, whereby an annular portion of the well bore bottom is subjected to the downward impression of the inserts in both of said intermediate rows and wherein a composite of said intermediate rows on said first, second and third cutter members show that the tips of the inserts form substantially a straight line without spaces between any of said rows.

3. A rotary drill bit for forming a well bore or the like, comprising:

a bit body having an axis of rotation and three projecting arms each said arm including a shaft defining an axis of cutter rotation with said axes intersecting at a common point;

a multiplicity of cutter members of generally conical configuration, each of said cutter members being journaled on a respective one of said shafts and having a nose and a base, said base being oriented generally toward the wall of the well bore with each of said cutter members being essentially true rolling; and a plurality of outwardly projecting, circumferentially-spaced individual inserts mounted in sockets in each said cutter members and located in annular rows in each said cutter members for engaging the bottom of the well bore, wherein some of said annular rows of inserts are mounted in each said cutter member between said nose and base defining intermediate rows in each said cutter member, with each said intermediate row on one cutter being matched by an intermediate row on another cutter member, said matched intermediate rows being located on said cutter members at substantially the same radial distance from said bit axis of rotation, said intermediate rows on said multiplicity of cutter members being completely out of intermesh.

4. A rotary drill bit for forming a well bore or the like, said bit comprising:

a bit body having an axis of rotation, an upper end connectable with a drill string for rotating said bit, and three downwardly projecting arms, each of said arms including an inwardly and downwardly inclined shaft defining an axis of cutter rotation, all of said axes intersecting at substantially a common point;

first, second and third cutter members of generally conical configuration, each of said cutter members being journaled on a respective one of said shafts and having a nose and a base, said base being oriented generally toward the wall of the well bore;

a plurality of outwardly projecting, circumferentially-spaced individual inserts mounted in sockets in each said cutter member and located in annular rows in each said cutter member for engaging the bottom of the well bore, said first, second and third cutter members being essentially true rolling thereby introducing essentially no scraping, gouging or tearing action to said inserts and said annular rows of said first, second and third cutter members being completely out of intermesh;

the annular rows of inserts in said first cutter member including a multiplicity of intermediate rows disposed between said nose and said base; and the annular rows of inserts in said second cutter member including a multiplicity of intermediate rows disposed between said nose and said base, at least two of the intermediate rows of said first cutter and at least two of the intermediate rows of said second cutter being spaced at approximately the same distances from said bit body axis of rotation so that the inserts in said rows engage the bottom of the well bore at approximately the same distances from said bit body axis of rotation.

5. A rotary drill bit for forming a well bore or the like by removing the formations at the bottom of the well bore leaving a well bore wall, said bit comprising:

a bit body having a bit axis of rotation, an upper end connectable with a drill string for rotating said bit, and three downwardly projecting arms with each of said arms including an inwardly and downwardly inclined shaft defining an axis of cutter rotation, all of said axes substantially intersecting at a common point;

first, second and third cutter members of generally conical configuration, each of said cutter members being journaled on a respective one of said shafts and having a nose and a base, said base being oriented generally toward the wall of the well bore;

a plurality of outwardly projecting, circumferentially-spaced inserts located in annular rows in each of said cutter members for engaging the bottom of the the well bore; and each of said first, second and third cutter members including intermediate rows of inserts disposed between the nose and base of said cutter members with each intermediate row on said first cutter member having a companion intermediate row on one said second or third cutter member with each said intermediate row on said first cutter member and companion intermediate row on one said second or third cutter member spaced from said bit axis of rotation by approximately the same distance, whereby an annular portion of the well bore bottom is subjected to the downward impression of the inserts in both of said intermediate rows wherein a composite of said inserts in said intermediate rows on said first, second and third cutter members have the tips of the inserts forming substantially a straight line without spaces between any of said rows; said first, second and third cutter members being essentially true rolling thereby introducing essentially no scraping, gouging or tearing action to said inserts in said intermediate rows of said first, second and third cutter members; said intermediate rows of said first, second and third cutter members being completely out of intermesh.

* * * * *

UNITED STATES PATENT OFFICE

CERTIFICATE OF CORRECTION

Patent No. 4,056,153 Dated November 1, 1977

Inventor(s) Raul A. Miglierini

It is certified that error appears in the above-identified patent and that said Letters Patent are hereby corrected as shown below:

In the claims:

Claim 1, line 44, insert --inserts-- before "mounted".

Signed and Sealed this

Fourteenth Day of February 1978

[SEAL]

*Attest:*

RUTH C. MASON
*Attesting Officer*

LUTRELLE F. PARKER
*Acting Commissioner of Patents and Trademarks*